US006237365B1

(12) United States Patent
Trebble

(10) Patent No.: US 6,237,365 B1
(45) **Date of Patent: *May 29, 2001**

(54) APPARATUS FOR AND METHOD OF SEPARATING A HYDROCARBON GAS INTO TWO FRACTIONS AND A METHOD OF RETROFITTING AN EXISTING CRYOGENIC APPARATUS

(75) Inventor: Mark Trebble, De Winton (CA)

(73) Assignee: TransCanada Energy Ltd., Calgary (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/009,242

(22) Filed: Jan. 20, 1998

(51) Int. Cl.[7] ..... F25J 3/02
(52) U.S. Cl. ..... 62/621; 62/902
(58) Field of Search ..... 62/621, 902

(56) References Cited

U.S. PATENT DOCUMENTS

| | | | |
|---|---|---|---|
| 2,769,321 | 11/1956 | Stiles . | |
| 3,292,380 | 12/1966 | Bucklin . | |
| 3,362,175 | 1/1968 | Burns et al. . | |
| 3,626,448 | 12/1971 | Crawford et al. . | |
| 3,656,311 | 4/1972 | Kaiser . | |
| 3,702,541 | 11/1972 | Randall et al. . | |
| 3,959,085 | 5/1976 | De Graff . | |
| 4,061,481 | 12/1977 | Campbell et al. . | |
| 4,140,504 | 2/1979 | Campbell et al. . | |
| 4,155,729 | 5/1979 | Gray et al. . | |
| 4,157,904 | 6/1979 | Campbell et al. . | |
| 4,171,964 | 10/1979 | Campbell et al. . | |
| 4,272,270 | 6/1981 | Higgins . | |
| 4,278,457 | 7/1981 | Campbell et al. . | |
| 4,444,577 | 4/1984 | Perez . | |
| 4,453,956 | 6/1984 | Fabbri et al. . | |
| 4,453,958 | 6/1984 | Gulsby et al. . | |
| 4,456,461 | 6/1984 | Perez . | |
| 4,519,824 | 5/1985 | Huebel . | |
| 4,600,421 | 7/1986 | Kummann . | |
| 4,617,039 | 10/1986 | Buck . | |
| 4,657,571 | 4/1987 | Gazzi . | |
| 4,687,499 | 8/1987 | Aghili . | |
| 4,720,293 | 1/1988 | Rowles et al. . | |
| 4,851,020 * | 7/1989 | Montgomery, IV | 62/621 |
| 4,854,955 | 8/1989 | Campbell et al. . | |
| 4,861,360 | 8/1989 | Apffel . | |
| 4,869,740 | 9/1989 | Campbell et al. . | |
| 4,889,545 | 12/1989 | Campbell et al. . | |
| 4,895,584 * | 1/1990 | Buck et al. | 62/621 |
| 5,275,005 * | 1/1994 | Campbell et al. | 62/621 |
| 5,372,009 | 12/1994 | Kaufman et al. . | |
| 5,555,748 * | 9/1996 | Campbell et al. | 62/621 |
| 5,566,554 | 10/1996 | Vivayaraghavan et al. . | |
| 5,568,737 | 10/1996 | Campbell et al. . | |
| 5,678,424 | 10/1997 | Nazar . | |

FOREIGN PATENT DOCUMENTS

| | | |
|---|---|---|
| 1041003 | 10/1978 | (CA) . |
| 1048397 | 2/1979 | (CA) . |
| 1249769 | 2/1989 | (CA) . |
| 1307454 | 9/1992 | (CA) . |
| WO 96/40604 | 12/1996 | (WO) . |
| WO 98/17609 | 4/1998 | (WO) . |

* cited by examiner

*Primary Examiner*—Ronald Capossela
(74) *Attorney, Agent, or Firm*—Bereskin & Parr

(57) ABSTRACT

Disclosed is an improved cryogenic demethanizer, for separating an inlet hydrocarbon gas having a mixture of hydrocarbon components into a residual lighter gas fraction and a heavier liquid fraction. The fractionation column in the demethanizer has a main body portion and an upper portion enlarged with respect to the main body portion. A packing which may be in the form of a plurality of contact trays, or random packing is located in the upper enlarged portion of the column. The invention may be used to retrofit existing cryogenic demethanizers, or used in new installations.

40 Claims, 9 Drawing Sheets

PERFORMANCE TEST AT 501.3 MMSCFD
59.6 MMSCFD SPLIT FLOW TO DEMETHANIZER
ETHANE RECOVERY = 85.4%
PROPANE RECOVERY = 98.9%
TEMPERATURE PROFILE IN DEGREES F

APPARATUS FOR AND METHOD OF SEPARATING A HYDROCARBON GAS INTO TWO FRACTIONS AND A METHOD OF RETROFITTING AN EXISTING CRYOGENIC APPARATUS

FIELD OF THE INVENTION

The present invention relates to an apparatus for and a method of separating or fractionating a hydrocarbon gas, comprising at least methane and ethane, into a residue gas comprising mainly methane and a heavier fraction comprising principally ethane and other heavy hydrocarbons, and to a method of retrofitting an existing cryogenic plant or apparatus so as to be capable of carrying out the method. The gas will usually be natural gas, received as either a gas or a liquid, and including ethane, propanes, butanes and higher or heavier hydrocarbons. More specifically, the invention relates to an improved fractionation column to separate ethane and heavier components, often referred to as "ethane plus" cryogenically from methane and heavier hydrocarbons. The column may be used in new facilities, or may be used as a retrofit with existing facilities.

BACKGROUND TO THE INVENTION

Cryogenic techniques and apparatus to separate methane and/or ethane (as well as other lighter gases such as carbon dioxide and nitrogen) from a gas containing a mixture of hydrocarbon gases have long been known. Such an apparatus is commonly called a "demethanizer". While the term "demethanizer" will be used throughout, it is to be understood that the apparatus and methods described may also be used in other applications whereby the demethanizer would be operated as a deethanizer. Typically, the purpose of a gas processing facility is to receive a gas from a transmission line, efficiently cool and depressurize the gas, extract the more valuable heavier components (ethane and heavier hydrocarbons, referred to as "ethane plus"), reheat and recompress the gas, and feed it back into the transmission line.

Typically, in such an operation, an inlet gas is introduced into a process facility at a high pressure. The gas is then allowed to expand and cool in various stages, and the liquid and gas fractions are then separated into different streams. After several stages of expansion and cooling, the various hydrocarbon streams are introduced into a fractionation column, or demethanizer, at different heights in the column. The methane gas is then separated from the heavier components of the gas, with the methane component exiting the fractionation column through the top of the column as a residue gas, and the heavier components exiting the column at its lower portion (collected as a liquid).

In the fractionation column, there is typically located a packing, which may be in the form of a number of contact trays. However, any suitable packing or construction can be used that promotes contact between the vapour and liquid flows. Thus, conventional Raschig rings or other standard packing materials can be used in the column. This packing is designed to increase mass transfer contact between the falling liquids and rising gases within the column, which increases the efficiency of liquid-gas separation in the fractionation column. As well, there is usually located at the upper portion of the fractionation column an enlarged empty "disengagement section". Typically, the stream entering the fractionation column at its upper portion (in the disengagement section) comprises between about 5% and about 50% liquid phase when it enters the fractionation column. The disengagement section allows the liquids entering the fractionation column space to separate or "deentrain" from the vapours with which it is mixed. The empty disengagement section is designed to alleviate potential problems of carry-over of hydrocarbon liquids into the demethanizer overhead stream (which is supposed to be vapour). This results in a loss of hydrocarbon liquid product. Conventionally, the disengagement section is of a large diameter (about 10 to 18 feet) and is about ten to fifteen feet in height.

It has also been known that, to increase the efficiency of a standard demethanizer, to increase the amount of heavier hydrocarbons removed, additional packing or contact trays may be added in a separate column, which is connected with the fractionation column. In order to obtain a useful increase in efficiency, however, it has been thought that at least eight additional trays, and as many as twenty additional contact trays were required in this separate column. Therefore, the modification of existing facilities to obtain an increase in efficiency has previously been very expensive, since a whole new column (and all of the additional equipment associated with it) was required.

One known process for separating different components in a hydrocarbon gas stream is disclosed in U.S. Pat. No. 4,278,457 (to Campbell and assigned to The Ortloff Corporation). The claimed improvement in that patent is to divide the feed gas stream into two separate streams, one of which is cooled and then depressured through an expander, while the other of which is cooled to a greater degree and is then depressured through a simple expansion valve. The separate first and second streams are then supplied to the fractionation column at different feed points.

This U.S. patent discloses a number of different examples, which either operate at a flow rate of 6588 lb moles/hr or at a quarter of this flow rate, i.e. 1647 lb moles/hr. Interestingly, in three examples, where the input gas flow is separated into three separate inputs, and where a substantial portion, as much as 76%, of the input gas flow, passes either into the middle or bottom inlet of the column, the lower flow rate of 1647 lb moles/hr is given. Moreover, this patent does not discuss, in any way, details of the column design, in terms of diameter required at different heights, number of trays or number of trays between different inlets.

Even more particularly, in this Ortloff patent, there is no detailed direction as to the number of trays that might be required between a middle inlet and a top inlet to a fractionation column, where the major portion of the gas is supplied to the middle inlet, and a small portion is provided, substantially in the liquid phase, to the top inlet.

Supplying a substantial portion of the inlet gas to a middle inlet of the column gives a number of problems. In particular, this has a significant impact on the dimensions of the column. By far the largest portion of the feed gas is methane, which in the column travels upwards as a vapour. When a major portion of the supply gas is fed to one inlet, the column, above that inlet, will need to have a sufficient diameter to accommodate the upward flow of methane and heavier components in the vapour phase. To keep the methane velocities reasonable, and in known manner to prevent entrainment of the heavier component liquid droplets to be carried overhead out of the column with the methane, requires a large diameter for the column. Clearly, this diameter or cross-section will be related to the intended flow rate through the apparatus.

This requirement for a relatively large cross-section where there is a large flow of methane in the vapour phase, has often resulted in a second column being provided, as mentioned above. Thus, in view of the conventional teaching that a significant number of trays would need to be provided in any such enlarged upper section, this would often result in a top section for the column that was simply too large to be supported on top of the lower section. For this reason, such a section was often provided as a separate column.

Other hydrocarbon gas separation techniques and apparatus can be found in U.S. Pat. No. 3,702,541 (Randall et al.), U.S. Pat. No. 4,519,824 (Huebel) and U.S. Pat. No. 5,566,554 (Vijayaraghavan et al.). All of these patents disclose relatively complex techniques. What is also striking about all of these three proposals is that no portion of the inlet gas stream is taken off and fed separately to the fractionating column. Rather, it appears that the inventors, in all of these cases, have assumed that it is advantageous to achieve some separation of the inlet gas, before feeding this into the fractionation column. The assumption appears to be that if there is some initial separation, e.g. liquid/vapour separation, then this will improve the overall performance of the system. Thus, all of these proposals provide at least one separator in which vapour and gas phases are separated.

The Randall et al. patent is of interest, since the inlet gas flow is split into three separate streams, by way of liquid and vapour separators, to provide three separate inlets to the fractionation column, these being provided at various levels in the lower stripping section of the column. The column here is provided with an upper rectifying section of larger diameter. Gas taken off from the top of the column is separated into liquid and vapour fractions, and the liquid fraction is pumped back up to the top of the column, and fed into the top of the rectifying section.

Again, there is no discussion of the size problems where a substantial portion of inlet gas is fed in below the top of the fractionation column, resulting in a substantial flow upwards through the top part of the column. This problem becomes particularly acute, where a plant is designed for large flow rates. Thus, the present invention is intended to provide a plant or apparatus suitable for a flow rate as large as a thousand (1000) MMSCFD, approximately equivalent to 116500 lb moles/hr, i.e. a flow rate that is an order of magnitude or more greater than that in some of the prior art proposals discussed above. In conventional design practices, for such a large flow rate, the upper part of the fractionation column can require diameters approaching 20 feet, and it is impractical to support such large diameter sections on top of much smaller diameter lower sections.

Another common characteristic of all of these earlier proposals is that there is no detailed investigation or consideration of the behaviour at the top of the fractionation column. Conventional teaching is that a substantial disengagement section needs to be provided above the top trays, to ensure adequate and complete separation of vapour and liquid phases, so as to ensure that liquid droplets are not carried over by the vapour flow leaving the top of the fractionation column. As detailed below, on an actual plant implementation of this invention, the size of the disengagement space was reduced from 10½ to 2½ feet and no liquid carry over has been observed during several months of operation.

SUMMARY OF THE INVENTION

In accordance with one aspect of the present invention, there is provided an apparatus for cryogenically separating an inlet hydrocarbon gas stream comprising at least methane and ethane into a residue gas stream comprising a major portion of the methane and a heavier hydrocarbon fraction comprising principally ethane and other heavier hydrocarbons, the apparatus comprising:

(1) a main inlet for the hydrocarbon mixture;

(2) a main stream connected to the main inlet and including a separator for separating liquid and vapour phases, the separator having a liquid phase outlet and a vapour phase outlet;

(3) a liquid phase stream connected to the liquid phase outlet and a vapour phase stream connected to the vapour phase outlet;

(4) a branch stream connected to the main inlet;

(5) a fractionation column including first, second and third inlets, the first inlet being connected to the liquid phase stream, the second inlet being connected to the vapour phase stream and the third inlet being connected to the branch stream, whereby the flow through the third inlet has substantially the same composition as the inlet gas, the second inlet being provided above the first inlet and the third inlet being provided above the second inlet;

(6) a first outlet means located at the bottom of the fractionation column for the heavier hydrocarbon fraction and a second outlet means at the top of the fractionation column for the residue stream;

(7) an outlet conduit connected to the second outlet means;

(8) first means for cooling the branch stream, including a first heat exchanger means provided between the outlet conduit and the branch stream for heat exchange therebetween, for cooling the incoming hydrocarbon gas branch stream and heating the residue gas stream in the outlet conduit; and (9) second means for expanding and cooling the main stream.

Preferably, the fractionation column includes a body portion of relatively small diameter and an upper portion of relatively large diameter, and a transition section between the body portion and the upper portion, and the first inlet is provided towards the upper end of the body portion, the third inlet is provided in the upper portion of relatively large diameter, and the second inlet is provided in the transition section.

The fractionation column preferably includes packing comprising a plurality of trays. An important aspect of the present invention is the discovery that these trays can provide a tray efficiency much greater than usual. As such only a small number of trays is required, and there could be from one to six trays in the upper portion. Also, a disengagement zone much smaller than that usually provided can be used, as it has also been discovered that this still gives adequate separation and disengagement.

Another aspect of the present invention is directed to retrofitting an existing plant and provides a method of retrofitting an existing cryogenic apparatus for separating a compressed inlet hydrocarbon gas stream comprising at least methane and ethane into a residue fraction comprising a major portion of the methane and a heavier hydrocarbon fraction comprising principally ethane and other heavier hydrocarbons, said existing apparatus comprising:

(a) a main inlet for the hydrocarbon gas;

(b) means for expanding and cooling the inlet gas into a mixture of liquid and vapour phases connected to the main inlet;

(c) means for separating said liquid and vapour phases comprising:

(i) a fractionation column having a body portion and an upper portion above the body portion and generally enlarged with respect to the body portion, said upper portion being substantially empty and being originally intended to provide a disengagement zone;

(ii) at least one inlet means for supplying the vapour and liquid phases to the column provided on at least the body portion and connected to the means for expanding and cooling the inlet gas;

(iii) a first outlet means located at the bottom of the bottom portion for withdrawing the heavier hydrocarbon fraction from the column;

(iv) a second outlet means located at the top of the upper portion for withdrawing the residue stream from the column; and (v) packing means in said body portion for increasing the amount of contact between the liquid and vapour phases; the method comprising:

(1) providing additional packing in the disengagement zone in the upper enlarged portion of the column to provide additional contact between the liquid and vapour phases;

(2) providing a branch stream between the main inlet and the upper portion; and (3) a first heat exchange means in the branch stream, for cooling the branch stream so that at least a portion of the branch stream is in the liquid phase, whereby hydrocarbons discharging into the upper portion from the branch stream are at least partially liquid.

Again the additional packing in the upper portion of the column can comprise a plurality of trays, e.g. one to six, spaced vertically in said upper portion of the column. There can be three trays provided in an upper portion which is approximately 12½ feet in diameter and approximately 10 feet high, and the trays are positioned in the upper portions so as to leave a disengagement zone of less than three feet.

The upper portion can include a frustro-conical portion, and in this case one of the trays is provided extending into the frustro-conical portion.

Yet another aspect of the present invention provides a method of separating a hydrocarbon feed gas stream comprising at least methane and ethane into a residue fraction comprising a major portion of the methane and a heavier hydrocarbon fraction comprising principally ethane and other heavier hydrocarbons, the method comprising:

(1) passing the hydrocarbon gas stream through a first heat exchange means to cool the gas stream;

(2) separating the gas stream into first, second and third streams, with the second stream comprising a major portion of the gas flow;

(3) expanding the gas, after it has been cooled, to lower the temperature of the first, second and third streams, wherein the third stream, after cooling and expansion, is substantially in the liquid phase;

(4) providing a fractionation column comprising a lower portion having a relatively small diameter, an upper portion having a relatively large diameter, and a transition section therebetween and a packing within the lower and upper portions, wherein the packing comprises, for the upper portion, a small number of trays;

(5) supplying the third stream to the top of the upper portion, the second stream to the top of one of the transition section and one of the upper and lower portions adjacent the transition section and the first stream to the lower portion below the second stream;

(6) collecting the residue gas stream from the top of the upper portion and the heavier hydrocarbon fraction from the bottom of the lower portion, wherein the residue gas stream passes through the first heat exchange means to reheat the residue gas stream and cool the incoming gas.

Preferably, the method comprises: splitting the inlet hydrocarbon gas stream into a main stream and a branch stream, the branch stream comprising the third stream and the main stream being subsequently split into the first and second streams. Furthermore, a portion of the hydrocarbon feed gas stream can be split off into a further branch stream, and the further branch stream is then passed through reboiling means and then recombining the further branch stream with the main stream, the reboiler means, reboiling lighter hydrocarbon fractions from the fractionation column.

One embodiment of both the method and the apparatus of the present invention includes a static mixer, to which the vapour phase outlet of the expander and the branch or third stream are connected, wherein the second and third inlets to the fractionation column are combined and are connected to the outlet of the static mixer, the combined second and third inlets being provided at the top of the fractionation column, whereby the static mixer causes contacting between the branch stream and the liquid phase stream prior to the fractionation column.

Advantageously, the static mixer is sized to provide mass transfer substantially equivalent to one theoretical stage of contacting in a fractionation column.

In some instances, a separator may be utilized to separate the two phase stream leaving the expander. In this type of process configuration, the vapours from the separator are not directed to the demethanizer column but join directly with the overhead vapours leaving the demethanizer column. The liquids from the separator are generally sent as the top feed to the demethanizer column. This type of process results in a smaller column diameter but has the requirement of an additional separator vessel. Retrofitting this type of process is somewhat different since it is generally less effective, with respect to ethane recovery, to install trays in the overhead disengagement section. The static mixer approach is then useful since the third stream mentioned above, which is essentially condensed inlet gas, can be mixed with the expander outlet and sent through a static mixing device upstream of the separator vessel. This results in substantial additional cooling and absorption of the expander outlet stream and produces significantly more liquid feed to the demethanizer column which results in higher recoveries of ethane and heavier components.

BRIEF DESCRIPTION OF THE DRAWINGS

These and other advantages of the present invention will be more fully and completely understood, when the following detailed description of the preferred embodiment is read in connection with the following drawings, in which.

DETAILED DESCRIPTION OF THE PREFERRED EMBODIMENT

Figure 1:
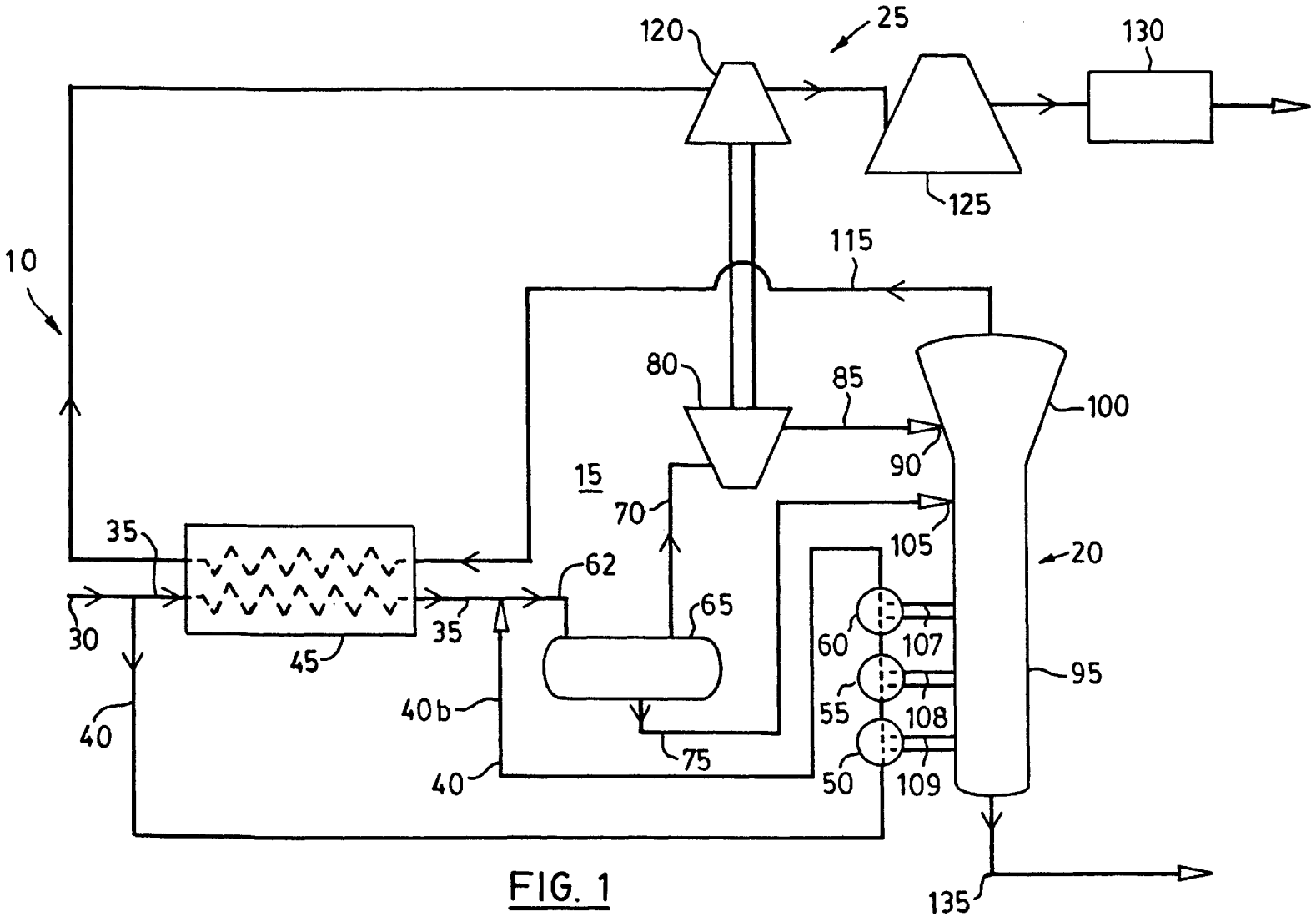
FIG. 1 is a schematic drawing of a conventional apparatus for separating methane from a hydrocarbon gas.

Referring to FIG. 1, there is shown schematically a typical conventional cryogenic separation plant, referred to generally by reference numeral 10. The plant 10, has an expansion and cooling area 15, a fractionation column demethanizer 20, and a recompression area 25. While a conventional demethanizer will be described here in general terms, it is to be understood that this is not to be considered limiting to the present invention, which may be used with any existing conventional demethanizer, or as a new installation. Additionally, the process conditions associated with the demethanizer will also be described only generally, since they are not limiting, and any person skilled in the art will understand all of the equipment and conditions, and how they may be modified if desired.

A compressed inlet gas which may comprise methane, ethane, propane and heavier hydrocarbons, as well as smaller amounts of carbon dioxide, nitrogen and other gases, enters the plant 10 into the expansion area 15, through an inlet 30, where it is divided into two streams 35 and 40. The inlet gas may be at a temperature of about 65° F. and at a pressure of about 400 to 1200 p.s.i.a.

The stream 35 then enters a heat exchanger 45, where the gas is cooled through heat exchange, for example to a temperature of about −85° F. The stream 40, which is split off from stream 35 before entering heat exchanger 45, is directed through a series of heat exchangers 50, 55 and 60. The heat exchangers 50, 55 and 60 provide reboiling for the fractionation column 20, which is required to maintain the methane content of the ethane plus liquid recovered typically below 2.0 mole %. This will be discussed below. Correspondingly, the heat exchangers 50, 55 and 60 cool the incoming gas to a temperature of approximately −75° F. and a pressure somewhat lower than the inlet pressure, solely due to pressure losses in the various pipes, heat exchangers, etc.

The streams 35 and 40 are then recombined downstream from the heat exchanger 45, into a combined stream 62. The stream 62 is then directed into a low temperature separator 65, where the liquid and gas phases are separated. The pressure in the separator 65 is approximately 550–1150 p.s.i.a. at a temperature of −85° F. The vapour phase leaves the low temperature separator 65 as an overhead stream 70, while the liquid phase leaves separator 65 through a bottom stream 75. The low temperature separator 65 is conventional, and is well known to those skilled in the art.

The vapour stream 70 is then depressured and further cooled in an expander 80, and subsequently directed as a stream 85 into the fractionation column 20 at point 90. The bottom stream 75 is typically reduced in pressure by passing through a valve (not shown), which causes flash evaporation or expansion to occur.

The fractionation column 20 has a main body 95, and an upper enlarged portion 100, and the inlet point 90, for the stream 85, is provided towards the bottom of the enlarged portion 100. The upper enlarged portion 100 may be described as generally conical or "belled" in shape. The design of the fractionation column 20 is conventional, including the upper enlarged portion 100, and is known to those skilled in the art. In the conventional design, the upper belled portion 100 of the fractionation column 20 is empty, and is designed to have a larger diameter than the main body 95. This area is known as a disengagement zone, and is provided to allow the hydrocarbon mixture entering the fractionation column 20 as the stream 85 (which is largely a vapour) an area where liquids entrained in the vapour phase may disengage from the vapour phase. As previously stated, this vapour phase may contain from about 5% to about 50% liquid content. The upper enlarged portion 100 is often between about 10 to 15 feet in height, and about 10 to 18 feet in diameter, depending on the volume of gas being processed.

The liquid portion exiting the low temperature separator 65 through the stream 75 is normally directed to a lower point 105 in the fractionation column 20, but above the location where reboiling streams 107, 108 and 109 leave the fractionation column 20 and are connected with heat exchangers 60, 55 and 50, respectively. This is typically near the upper portion of the main body 95 of the fractionation column 20, although this may vary from system to system. This reboiling system is required to maintain the methane content of the ethane plus stream leaving the fractionation column below 2.0 mole %. As will be appreciated, portions of the liquid phase falling through the fractionation column 20 are redirected out of the column 20, through the reboiling streams 107, 108 and 109, and are then passed through the heat exchangers 60, 55 and 50, respectively. This aids in the cooling of the inlet gas passing through these heat exchangers. The stream 40, now a cooled stream 40*b,* is recombined with stream 35 and are directed to the low temperature separator 65.

Within the main body 95 of the fractionation column 20, there is normally located a "packing", which may be in the form of a series of "trays" or contact plates (typical to those trays seen in FIGS. 6 and 7 as will be later discussed). The contact plates are designed to increase the contact between the liquid and the vapour phases in the fractionation column, which in turn increases the efficiency of the ethane and higher hydrocarbon recovery. In a typical installation, there would be between 15 and 30 trays at a spacing of 2 feet between adjacent trays. As noted above, any suitable packing, such as Raschig rings can be used instead of trays.

In the fractionation column 20, the vapour phase (mainly the methane content of the inlet gas) leaves the fractionation column 20 as an outlet stream 115, where it is directed through the heat exchanger 45, to aid in cooling to the inlet gas stream 35. The stream 115 is then recompressed, for example in a brake compressor 120, and is then further compressed to pipeline pressure utilizing a large compressor 125 and the compression section is generally indicated as 25. The stream is then passed through an aftercooler 130 to lower the residue gas temperature to a level suitable for reentry into a gas transmission line; as is known, for some applications, it may be possible to omit the aftercooler 130.

The more valuable heavier, liquid phase of the inlet gas (for example ethane and heavier) exits through the lower end of the column 20 as a stream 135, and is collected and stored appropriately.

All of the features thus described are conventional, and will be readily known and understood by persons skilled in the art.

Figure 2:
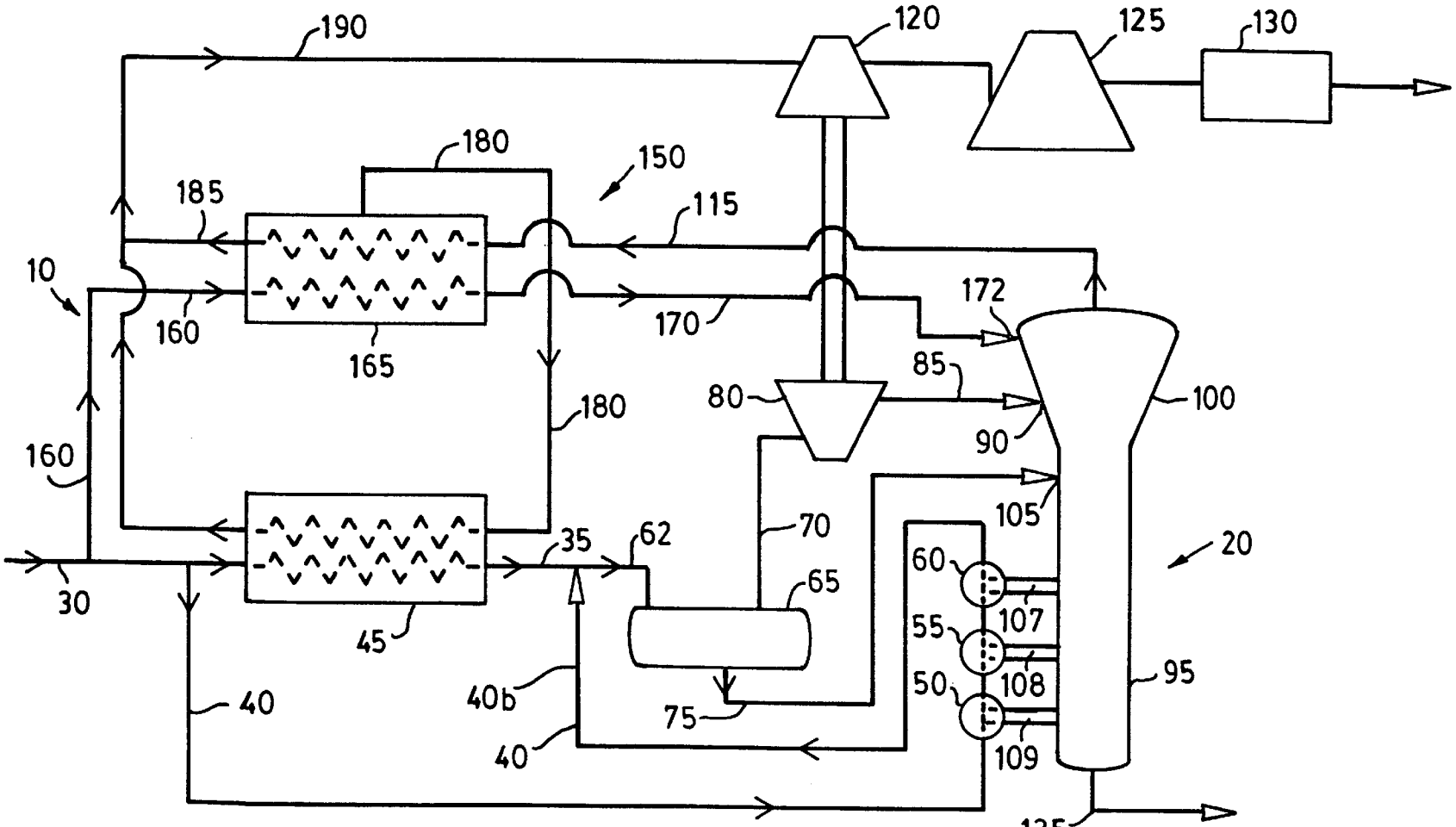
FIG. 2 is a schematic drawing of an apparatus in accordance with one aspect of the present invention.

Referring to FIG. 2, in the present invention, the plant 10 is again shown schematically and modified by (1) the addition of a reflux section 150, which allows the reflux of the vapours exiting the upper belled portion 100 of the fractionation column, and (2) the addition of trays or contact plates in the upper belled portion 100 of the fractionation column. These additional features provide increased efficiency of recovery of the heavier hydrocarbon components (ie. ethane and heavier).

For simplicity and brevity parts which are common between the apparatus of FIG. 1 and the apparatus of FIG. 2 are given the same reference numerals and description of these common components is not repeated.

In the present invention, the inlet gas stream 30 is initially split into three streams 35, 40 and 160 after entering the apparatus. The additional stream 160 is directed generally to the reflux section 150, and more specifically, through an additional heat exchanger 165, in which the stream 160 is cooled to a temperature of about −135° F. The heat exchanger 165 is conventional, and may be similar to the heat exchanger 45. Again, some form of throttle or expansion valve (not shown) would be provided, so as to reduce the pressure and cause flash expansion of the hydrocarbon stream.

After being cooled in the heat exchanger 165, the gas is expanded by an expansion valve (not shown) and sent directly to the fractionation column 20 as a stream 170, where it enters the fractionation column 20 at 172, near the top of the upper belled portion 100.

Figure 6:
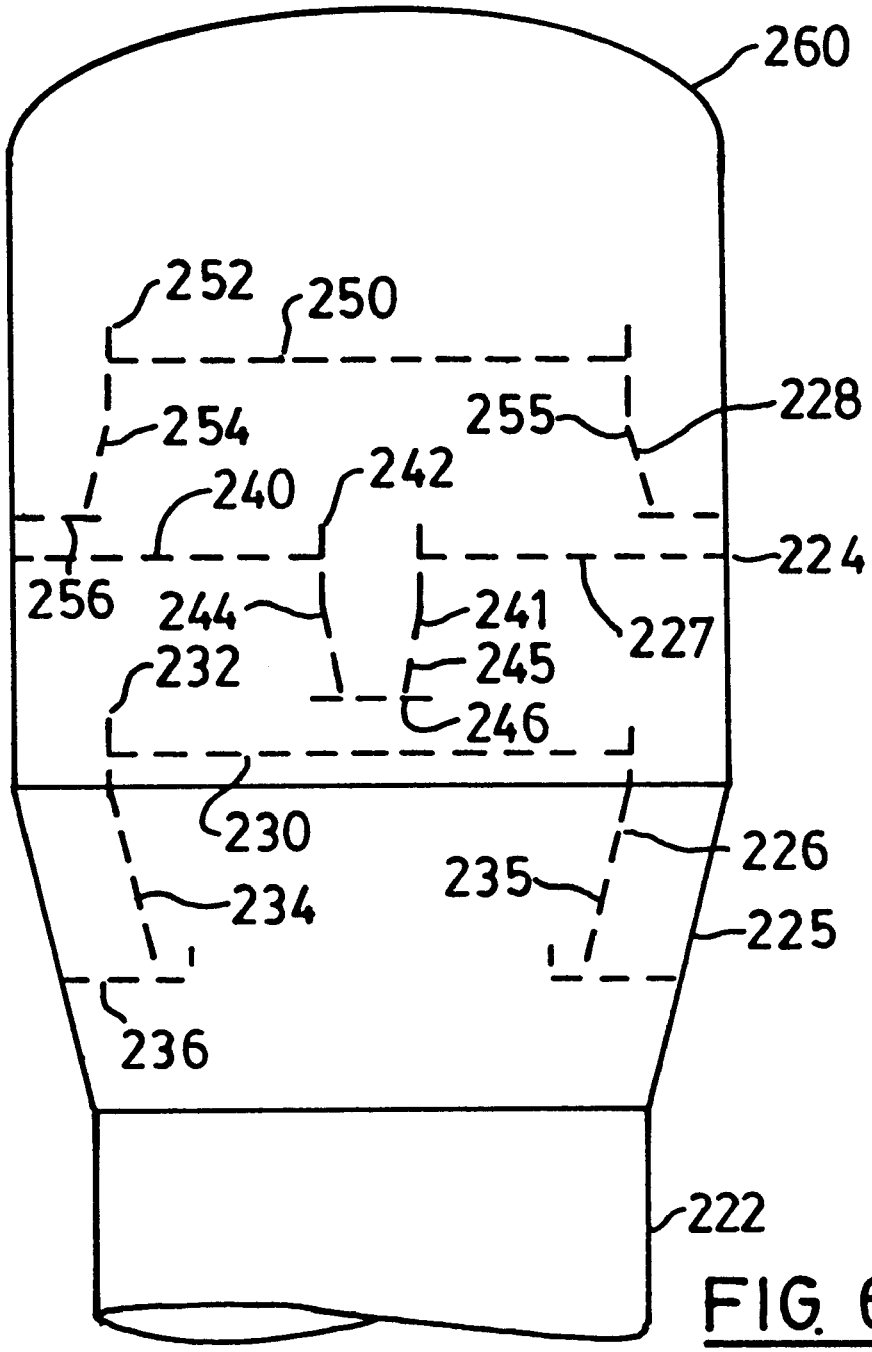
FIG. 6 is an elevational view of the top part of the fractionation column of FIG. 4, showing trays.

In the upper belled portion 100 of the fractionation column 20, there is located additional packing, which may be in the form of a series of additional trays or contact plates 226–228 (FIG. 6). The additional trays 226–228 may be similar to the trays located in the main body portion 95 of the fractionation column 20. These additional trays 226–228 are installed so as to leave a small disengagement zone between the upper most tray 228 and the upper limit of the fractionation column 20. It is at this location where the stream 170 enters the upper belled portion 100. The disengagement zone in the present invention may be as little as about two feet in height, in contrast to the prior art devices, which required a much larger disengagement zone, usually on the order of between about 10 to 15 feet in height. It has been surprisingly found that only a few additional trays 226–228 are required in the upper portion 100 of the column 20, to achieve a substantial increase in the recovery of ethane and heavier components from the column. It is believed that this is due to an unexpectedly and unusual high tray efficiency, which should be above 60, and is expected to exceed 80. In practice, the use of as few as three additional trays 226–228 has been sufficient to significantly increase the recovery, as will be discussed below.

The residue gas leaving the fractionation column 20 through stream 115 is then redirected through the heat exchanger 165, to cool the inlet gas passing through this heat exchanger. The residue gas is then split into two streams 180 and 185. The majority of the residue gas, of the order of 70 to 90%, is sent via stream 180 to the heat exchanger 45, also to aid in the cooling of the inlet gas stream entering this heat exchanger. The remainder of the residue gas exits the heat exchanger 165 as stream 185. The stream 180, after exiting the heat exchanger 45 is recombined with the stream 185, to form stream 190.

The combined stream 190 is then recompressed and cooled, as previously described, prior to exiting the process.

It was previously believed that it was unacceptable to include the additional contact plates in the upper belled portion 100, since it was believed that there would be insufficient room for the incoming liquid and vapour phases to separate from each other. It was believed that this would result in substantial liquid carryover and loss of hydrocarbon liquid through the upper stream 115 leaving the fractionation column 20. This would clearly be undesirable. Additionally, given that the upper enlarged portion 100 of the column 20 in existing facilities is of limited size (usually between 10 to 15 feet in height), it was believed that there was insufficient room to add an acceptable number of trays to obtain an increase in ethane plus recovery which was commercially acceptable. As previously mentioned, it was believed that a minimum of eight additional trays would be required to ensure sufficient mass transfer contact between the rising vapours and the falling liquids. This was due largely to the assumption that several theoretical stages of contact were required and that tray efficiencies would be quite low (e.g. 40–60%).

Therefore, if it was desired to increase the efficiency of the fractionation column 20, and in particular when it was desired to add a reflux section, such as section 150, to allow reflux of the residue gas, a separate contactor column would be constructed on the ground. In contrast, the present invention provides additional trays in the fractionation column. Therefore, such an installation would require a separate vessel between about 24 and 60 feet in height and a diameter of about 16 to 17 feet. Given the size of the separate vessel, it would not be feasible to place it on top of the fractionation column.

The cost of a second vessel is significant, and therefore, may often not be commercially feasible. Additionally, the extra equipment associated with the separate column, for example, a cryogenic pump to deliver the liquids from the second separator to the top of the demethanizer column, would significantly increase capital and operating costs.

In accordance with the present invention, it has surprisingly been found that the use of as few as three of these contact trays in the upper belled portion 100 of the fractionation column 20 can achieve almost the same level of efficiency as the use of eight to twenty trays, which requires a separate vessel, but at a much reduced cost. Surprisingly, a high tray efficiency of 82% has been obtained in a plant performance test, and this requires a much smaller number of trays to obtain the desired separation. Conventional design practices allow a tray efficiency of 45–60%. The fact that so few trays are required makes the size of the upper belled portion sufficiently small so that it can be supported by the main body 95 of the fractionation column 20.

In an unoptimized actual plant test, it was found that the present invention, through modification of an existing facility, increased ethane recovery by about 8.4%, from about 77% to about 85.4%, and propane recovery was increased from about 98% to about 98.9%. These increased efficiencies are each significant, particularly given the relatively minimal cost and time required to modify an existing system to achieve the benefit. In an optimized trial basis it is expected that the ethane recovery will increase by 11%. In simulated comparisons where a grass roots or new facility is proposed, ethane recovery was increased by about 11% as compared to a conventional design as depicted in FIG. 1.

The present invention enables the volume of the residue gas stream 115 to be reduced, because of the increased volume of liquid ethane and other substances removed from stream 85. In an actual plant test, using the same residue gas compressor horsepower, this enabled inlet gas rates to be increased from 489 million standard cubic feet per day to 501 million standard cubic feet per day.

Figure 3:
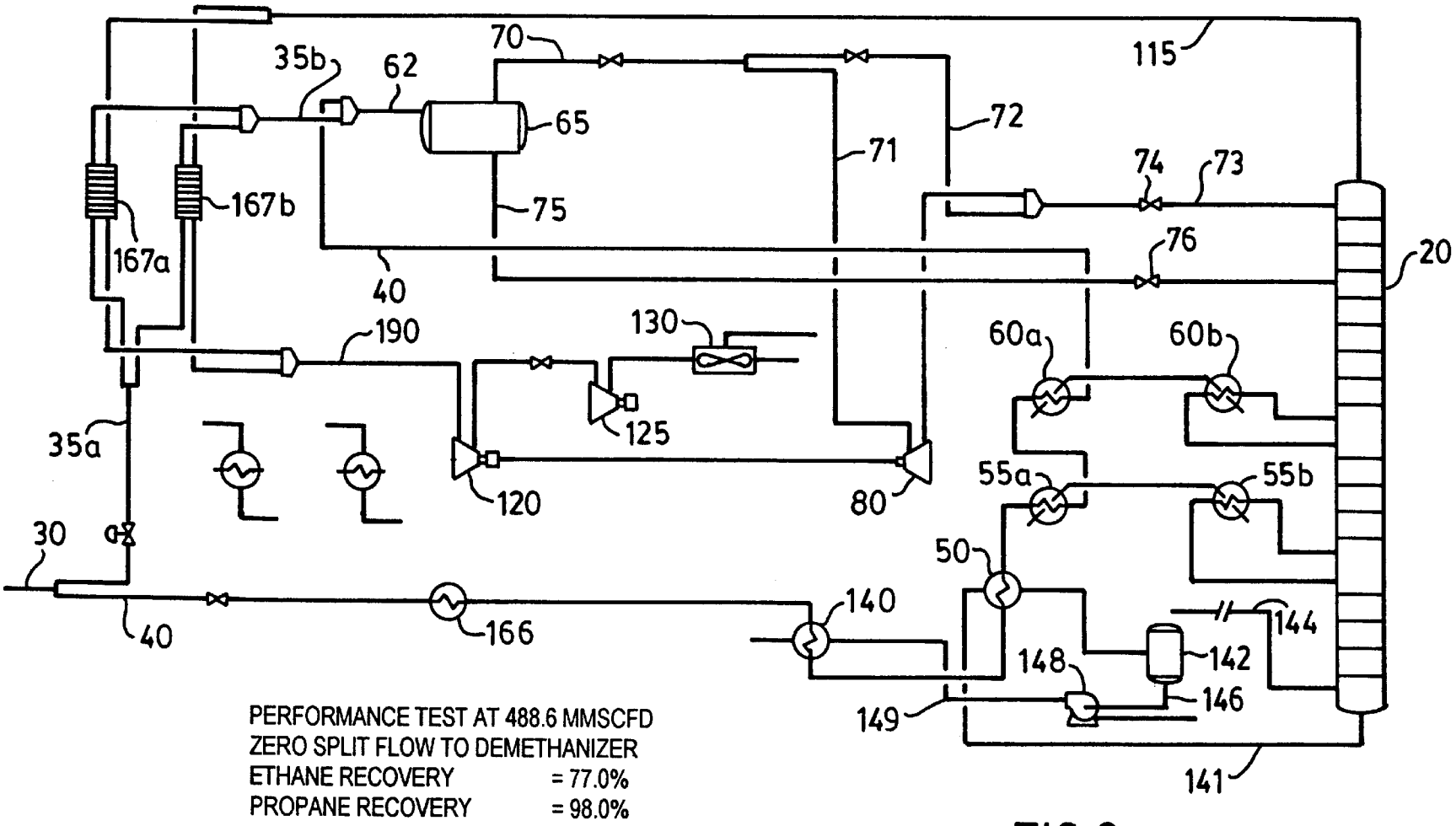
FIG. 3 is a drawing of a theoretical model of an apparatus, similar to the apparatus of FIG. 1.

This aspect of the invention will be better understood by reference to FIG. 3. This shows a theoretical schematic of the apparatus of FIG. 1. This has been analyzed using conventional software, Hysim, a software program licensed by Hyprotech Ltd. from Calgary. The overall layout is similar to FIG. 1, with the exception of the items outlined below. Otherwise, like components are given the same reference numeral and their description is not repeated.

In FIG. 3, the stream 40 passes through a heat exchanger 140 and exchanges heat with ethane plus recovered from the column. It then flows through the heat exchanger 50.

For the heat exchanger 50, a stream 141 is taken from the bottom of the column 20, passed through the heat exchanger 50 and then back to the fractionation column 20. The liquid from the fractionation column is connected to a stream 146 for liquid, which is delivered to a pump 148. The vessel 142 is shown for simulation purposes only. In practice the vessel 142 is part of the bottom of the fractionation column 20. The pump 148 discharges the recovered ethane and other products through line 149, which passes through the heat exchanger 140.

The heat exchanger 45 of FIGS. 1 and 2 is now configured as heat exchangers 167*a,* 167*b*. As shown, the stream 115 splits and then recombines prior to entering compressor 125 for flow through the heat exchanger 167*a,* 167*b*. The combined stream 115 flows to compressors 120, 125. Further, similar to the FIG. 2 embodiment, the line 40 and the line 35*b* combine, before entering the separation vessel 65.

The separation vessel 65 has the outlet stream 75 for liquid, connected to the fractionation column 20 as before. The vapour line 70 is provided with a main branch stream 71 connected through the expander 80 and then stream 73 to the top of the fractionation column 20. A bypass stream 72 is provided although as detailed below, it will often not be used. This enables the expander 80 to be bypassed, so that it can be serviced without shutting the whole processing plant down.

Figure 4:
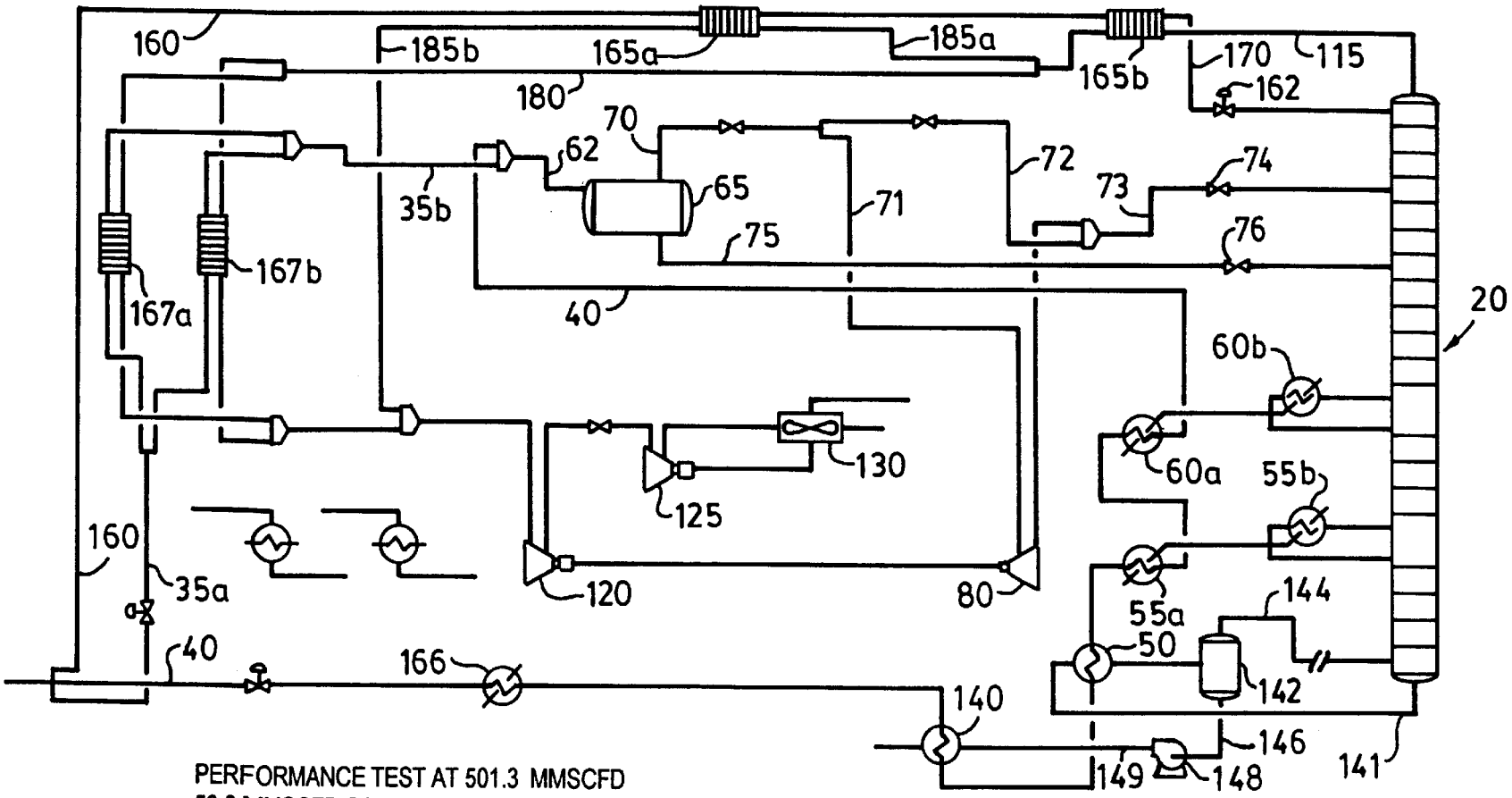
FIG. 4 is a drawing of a theoretical model of an apparatus, similar to the apparatus of FIG. 2.

FIG. 4 shows a theoretical model of the plant or apparatus of FIG. 2. Again, elements or components already identified and described are given the same reference numeral and description of them is not repeated, for simplicity and brevity.

As before, the principal difference between FIGS. 3 and 4, as for FIGS. 1 and 2, is the inclusion of a separate line 170 discharging into the top end of the column 20. Here, the expansion valve 162 for the line 170 is shown. Additionally, the heat exchanger 165 is shown as two separate heat exchange elements 165*a* and 165*b*. As for FIG. 3, two separate heat exchange elements 167*a* and 167*b* are shown, approximately corresponding to the heat exchanger 45.

For these two theoretical models, in FIGS. 3 and 4, theoretical performance results have been obtained, for temperature, pressure, molar flow rate and vapour fraction. These are set out in the following Tables 1 and 2.

TABLE 1

| Location | Temperature ° F. | Pressure p.s.i.a | Molar Flow lb moles/hr | Vapour Fraction |
|---|---|---|---|---|
| INLET STREAM 30 | 65.12 | 766 | 53650.57 | 1 |
| STREAM 40 | 65.12 | 766 | 18666.8 | 1 |
| exit from heat exchanger 166 | 64.87 | 762 | 18666.8 | 1 |
| exit from heat exchanger 140 | 53.5 | 758 | 18666.8 | 1 |
| exit from heat exchanger 60 | −73.04 | 746 | 18666.8 | .93 |
| STREAM 35a | 64.81 | 761 | 34983.77 | 1 |
| stream 35b | −88.18 | 754 | 34983.77 | .74 |
| stream 62 | −84.5 | 746 | 53650.57 | .82 |
| stream 70 | −84.5 | 746 | 44160.64 | 1 |
| stream 75 (upstream valve 76) | −84.5 | 746 | 9489.93 | 0 |
| stream 75 (downstream valve 76) | −132.68 | 316.22 | 9489.93 | .39 |
| stream 71 (upstream expander 80) | −85.47 | 736 | 44160.64 | 1 |
| stream 73 (upstream valve 74) | −144.59 | 290 | 44160.64 | .85 |
| stream 73 (downstream valve 74) | −140.57 | 316.22 | 44160.64 | .85 |
| STREAM 115 | −145.05 | 286 | 49907.72 | 1 |
| heat exchanger 167a exit (line 115) | 53.82 | 278 | 8889.79 | 1 |
| heat exchanger 167b exit (line 115) | 35.44 | 276 | 41017.93 | 1 |
| compressor 120 - entry (stream 190) | 38.7 | 276 | 49907.72 | 1 |
| compressor 120 - exit (stream 190) | 70.46 | 322.1 | 49907.72 | 1 |
| compressor 125 - entry | 69.47 | 306 | 49907.72 | 1 |
| compressor 125 - exit | 242.16 | 823 | 49907.72 | 1 |
| STREAM 141 (upstream heat exchanger 50) | 22.02 | 290 | 4876.1 | 0 |
| stream 141 (downstream heat exchanger 50) | 30.66 | 290 | 4876.1 | 0.23 |
| stream 144 | 30.66 | 290 | 1133.71 | 1 |
| stream 146 | 30.66 | 290 | 3742.39 | 0 |
| stream 149 - entry to exchanger 140 | 32.34 | 384.17 | 3742.39 | 0 |
| stream 149 - exit to exchanger 140 | 53.6 | 379.17 | 3742.39 | .01 |

TABLE 2

| Location | Temperature ° F. | Pressure p.s.i.a | Molar Flow lb moles/hr | Vapour Fraction |
|---|---|---|---|---|
| INLET STREAM 30 | 65.06 | 771 | 55044 | 1 |
| STREAM 40 | 65.06 | 771 | 16741.16 | 1 |
| exit from heat exchanger 166 | 64.93 | 769 | 16741.16 | |
| exit from heat exchanger 140 | 52.38 | 765 | 16741.16 | 1 |
| exit from heat exchanger 60 | −80.06 | 753 | 16741.16 | .87 |
| STREAM 35a | 64.87 | 768 | 31763.96 | 1 |
| stream 35b | −77.08 | 760.2 | 31763.96 | .9 |
| stream 62 | −78.54 | 753 | 48505.13 | 0.89 |
| stream 70 | −78.54 | 753 | 43066.88 | 1 |
| stream 75 (upstream valve 76) | −78.54 | 753 | 5438.24 | 0 |
| stream 75 (downstream | −128.6 | 301.23 | 5438.24 | .39 |

TABLE 2-continued

| Location | Temperature ° F. | Pressure p.s.i.a | Molar Flow lb moles/hr | Vapour Fraction |
|---|---|---|---|---|
| valve 76) | | | | |
| stream 71 (upstream expander 80) | −79.5 | 743 | 43066.88 | 1 |
| stream 73 (upstream valve 74) | −138.16 | 301.23 | 43066.88 | .87 |
| stream 73 (downstream valve 74) | −138.16 | 301.23 | 43066.88 | .87 |
| STREAM 160 | 65.06 | 771 | 6538.87 | 1 |
| stream 170 (upstream valve 162) | −147.74 | 757 | 6538.87 | 1 |
| stream 170 (downstream valve 162) | −156.36 | 300.7 | 6538.87 | 0.06 |
| STREAM 115 | 150.14 | 294 | 50877.09 | 1 |
| stream 185a | −111.76 | 289 | 4941.21 | 1 |
| stream 185b | 60.79 | 283.5 | 4941.21 | 1 |
| stream 180 | −111.76 | 289 | 45929.88 | 1 |
| heat exchanger 167a exit | 46.32 | 281 | 8995.2 | 1 |
| heat exchanger 167b exit | 40.72 | 279 | 36934.68 | 1 |
| compressor 120 - entry | 43.61 | 279 | 50871.09 | 1 |
| compressor 120 - exit | 73.77 | 324.4 | 50871.09 | 1 |
| compressor 125 - entry | 73.08 | 313 | 50871.09 | 1 |
| compressor 125 - exit | 243.32 | 823 | 50871.09 | 1 |
| stream 141 (upstream heat exchanger 50) | 17.03 | 298 | 5313.04 | 0 |
| stream 141 (downstream heat exchanger 50) | 27.54 | 298 | 5313.04 | .21 |
| stream 144 | 27.54 | 298 | 1139.81 | 1 |
| stream 146 | 27.54 | 298 | 4173.23 | 0 |
| stream 149 | 31.56 | 524.63 | 4173.23 | 0 |
| stream 149 (downstream heat exchanger 140) | 52 | 519.63 | 4173.23 | 0 |

A review of the values given in these two tables will show many close similarities, which might be expected, in view of the very similar flow rates. The significant differences are in the conditions and flow rates for the streams entering the fractionation column. Thus, in Table 1, the stream 75 enters at a temperature of −132.68° F. and a flow rate of 9489.93 lb moles/hr and stream 73 at a temperature of −144.59° F. and a flow rate of 44,160.64 lb moles/hr.

When modified to provide the third stream, as indicated in Table 2, the flow rate for stream 73, is decreased slightly to 43,066.88 at a temperature of −138.16° F. The bottom stream 75 is reduced to a greater extent to 5438.24 lb moles/hr and a slightly higher temperature of −128.6° F. However, there is now the additional top stream 170 which is introduced at a temperature of −156.36° F. and a flow rate of 6538.87. More significantly, while the vapour fractions for stream 73, 75, differ little between the two examples, stream 170 is introduced almost entirely in the liquid phase, with a vapour fraction of just 0.06. The effect of this is to provide, at the top three trays, an upward flow of methane, originating principally from stream 73, which meets a downward flow of liquid from stream 170, which is introduced in the liquid phase at a significantly lower temperature. The effect of this is to create a downward flow from the top three trays, which would ensure that a significant portion of ethane and other heavier hydrocarbons are absorbed from stream 73 and carried down through the column, and are not carried upwards with the methane gas.

Figure 5A:
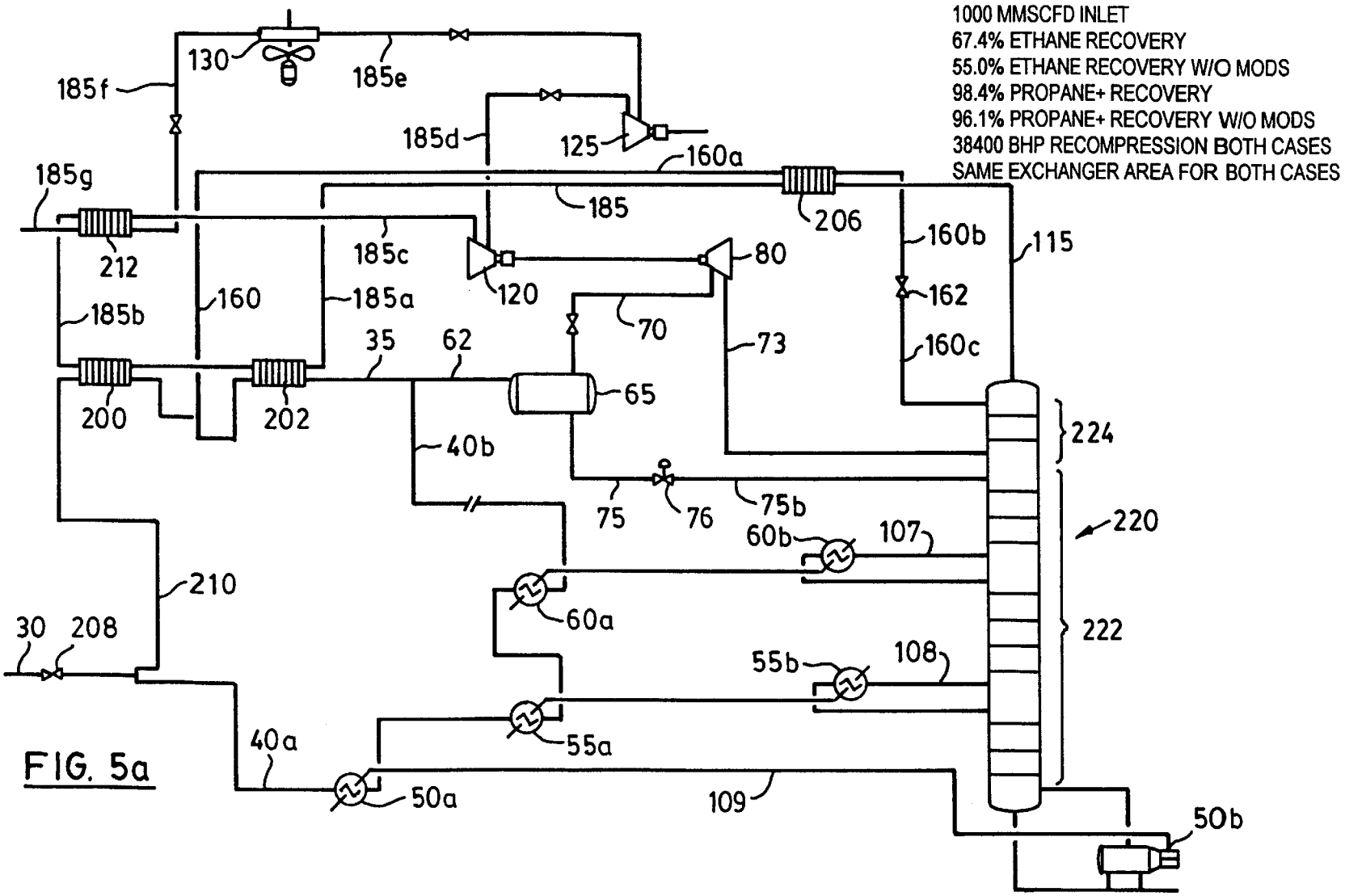
FIG. 5*a* is a drawing of a theoretical model of an apparatus in accordance with another aspect of the present invention.

Reference will now be made to FIG. 5*a,* which shows schematically an apparatus or plant in accordance with a second aspect of the present invention. This has been designed as a complete new plant or facility, rather than as a modification to an existing facility. However, again for simplicity and brevity, parts, common with earlier Figures, are given the same reference numerals, and description of these common components is not repeated.

Here, the heat exchangers 50, 55, 60 are represented by the two sides of the heat exchangers, as heat exchange elements 50*a,* 50*b* and 55*a,* 55*b,* 60*a,* 60*b* for the respective reboiling streams 109, 108, 107. To separately identify the inward end and outward end of the stream 40, this is designated as 40*a* for the stream flowing to the heat exchangers, and stream 40*b* leaving the heat exchangers.

The heat exchanger configuration in this embodiment is somewhat different. Here, broadly corresponding to the heat exchanger 45 of FIG. 1, there are two heat exchange elements 200, 202 through which the stream 35 flows. The stream for the returned residue gas is again indicated as 115, and after passage through a heat exchanger 206, the stream is indicated as 185. Due to the different configuration here, the designation 185 is used for the residue gas stream through to the compressor 120 and compressor 125. The additional heat exchanger 206 is provided, for heat exchange with the stream 160 passing to the top of the fractionation column 20.

The inlet stream 30 passes through a valve 208 to a stream 210, connected to the heat exchange elements 200, 202. Between the heat exchange elements 200, 202, the additional stream 160 is branched off, and passes through the heat exchanger 206 to the top of the column 20.

To enable the various streams to be identified at different points, primarily for identifying stream conditions as detailed below, various suffixes are used. Thus, the stream 160 is identified as 160*a* and 160*b* before and after the heat exchanger 206. This stream 160 also includes a throttle expansion valve 162, to cause flash expansion. The stream 185 is variously labelled as 185*a, b, c,* etc to identify the portions indicated on FIG. 4. For the streams from the separator 65, the liquid stream is identified as 75*b* after expansion through a valve 76, and the vapour stream is identified as 70 and 73 before and after expansion in the expander 80.

The plant of FIG. 5*a* is intended to handle 1.0 billion cubic feet of gas per day (BCFD), which enters through stream 30 at 613 p.s.i.a and 68° F. from a main gas transmission line. As before, the purpose of the apparatus is to receive gas from a transmission line, to efficiently cool and depressure the gas, to extract the valuable heavier components ("ethane plus", i.e. ethane and heavier hydrocarbons), and then to recompress the gas back into the transmission line. The inlet gas primarily comprises methane although it contains other species including carbon dioxide (0.2–1.5%), nitrogen (0.5–1.5%), ethane (3–8%), propane (0.5–2%), and heavier hydrocarbons (0.5–5% ). The objective of such apparatus is to provide an extraction facility to remove ethane, propane, and heavier hydrocarbons in substantive quantities for subsequent resale. The FIG. 5*a* apparatus is intended to extract over 60% of the ethane and over 99% of the heavier propane plus components.

A portion of the inlet gas is split off and sent through the side heat exchangers 50, 55, 60 on the distillation column 220 to provide reboiling. The remainder of the inlet gas is sent through exchanger element 200 where it is chilled to −36° F. using residue gas in line 185. Upon exiting exchanger 200, the inlet gas is once again split and a portion of the gas is sent through heat exchanger 206, where 84% of the stream is liquified. This stream then passes through the valve 162 and enters the top of the distillation or fractionation column 220. The remainder or bulk of the inlet gas passes through a second inlet gas exchanger 202 and is chilled to −72° F. This gas is then mixed with stream 40*b* and the combined flow is sent to separator 65. Vapours leaving separator 65 are expanded adiabatically in expander 80 from 595 p.s.i.a to 304 p.s.i.a causing the gas temperature to drop from −75° F. to −126° F. The expander 80 generates power from this expansion and the power is utilized in driving the brake compressor 120. Liquids from the separator 65 are sent to the distillation column through the valve 76.

The column, here indicated as 220, comprises two sections or portions: a smaller bottom section or portion 222 primarily dedicated to providing reboiling, and a larger top section or portion 224 which accomplishes a majority of the ethane recovery out of the inlet gas. The top section 224 is quite large for a 1.0 BCFD feed gas rate and here is 18 foot in diameter, which currently is close to the limit of what can be constructed within a reasonable cost. The bottom section 222 of the column is much smaller and has a diameter of 9 feet. The bottom section 222 would include 10–15 theoretical trays, equivalent to 18–24 actual trays; the top section 224 includes three theoretical trays, equivalent to four actual trays.

The example process produces an incremental ethane recovery of 12.4%, i.e. 67.4% as compared to 55% in a conventional plant; and incremental propane and recovery of between 2–3%, i.e. 98.4% as compared to 96.1%. Higher ethane recoveries would be attainable by increasing the size of the heat exchangers. This would cool the inlet gas to a greater degree or extent than if less heat exchange is provided, effectively increasing ethane flow down the column 220 and reducing the amount of ethane carried over with residue gas. Increasing recompression of the residue gas could draw down the temperature and pressure in the column, also leading to increased recoveries.

It can also be noted that a plant following the Ortloff design in U.S. Pat. No. 4,278,457 cannot be accomplished in a single column, since conventional engineering design would require the top section to be at least a 30 ft height with a 17 ft diameter. This could not practically be supported on top of a 9 ft diameter bottom section.

This particular configuration would be able to produce a range of ethane recoveries from 50% up to about 95% by increasing the horsepower of compressor 125 to reduce the pressure of the columns 220. Above 95% recovery the pressure in the distillation column would drop to much lower values and flooding may occur in the top section 224 of the column, thereby limiting the upper end of the recovery efficiency.

Residue gas leaving the top of the distillation column 220 is sent through exchanger 206, cooling the gas flow, and is subsequently sent through heat exchange elements 202 and 200, providing cooling for the inlet gas. This warms the residue or overhead gas up to 56° F. (at 185*b*) which is only slightly colder than the inlet gas temperature. The warm gas is then compressed at 120 to a pressure of 358 p.s.i.a using the power developed by the expander 80. The compressed gas is further compressed at 125 up to a high enough pressure to put it back into the main gas transmission line. Gas leaving the recompressor 125 is cooled by water or air in heat exchanger 130 and is further cooled by a heat exchanger 212 with upstream residue gas. In general, the residue gas is required to leave the plant at the same temperature at which is entered.

The following Table 3 sets out process parameters that would be obtained in the plant of FIG. 5*a,* again based on a theoretical simulation of the plant.

TABLE 3

| Location | Temperature ° F. | Pressure p.s.i.a | Molar Flow lb moles/hr | Vapour Fraction |
|---|---|---|---|---|
| INLET STREAM 30 | 68 | 598.28 | 116546.84 | 1 |
| STREAM 40a | 67.87 | 596.25 | 24596.25 | 1 |
| stream 40b | −86.82 | 590.74 | 24596.25 | 0.95 |
| MAIN STREAM 210 | 67.87 | 596.25 | 91950.59 | 1 |
| stream 35 | −93.35 | 590.74 | 80970.13 | 0.93 |
| STREAM 160a | −36.0000 | 593.49 | 10980.47 | 1 |
| stream 160b | −137.19 | 578.49 | 10980.47 | 0 |
| stream 160c | −152.14 | 329.83 | 10980.47 | 0.12 |
| stream 35 | −93.35 | 590.74 | 80970.13 | 0.93 |
| stream 62 | −91.93 | 590.74 | 105566.38 | 0.94 |
| stream 75b | −122.27 | 331.83 | 6780.64 | 0.23 |
| stream 70 | −92.28 | 587.69 | 98785.74 | 1 |
| stream 73 | −132.76 | 329.83 | 98785.74 | 0.94 |
| STREAM 115 | −140.57 | 327.83 | 111113.67 | 1 |
| stream 185a | −112.94 | 322.83 | 111113.67 | 1 |
| stream 185b | 56.2 | 320.02 | 111113.67 | 1 |
| stream 185c | 99.94 | 313.49 | 111113.67 | 1 |
| stream 185d | 122.89 | 358.67 | 111113.67 | 1 |
| stream 185e | 223.99 | 626.71 | 111113.67 | 1 |
| stream 185f | 109.94 | 621.63 | 111113.67 | 1 |
| stream 185g | 69.08 | 613.51 | 111113.67 | 1 |

Figure 5B:
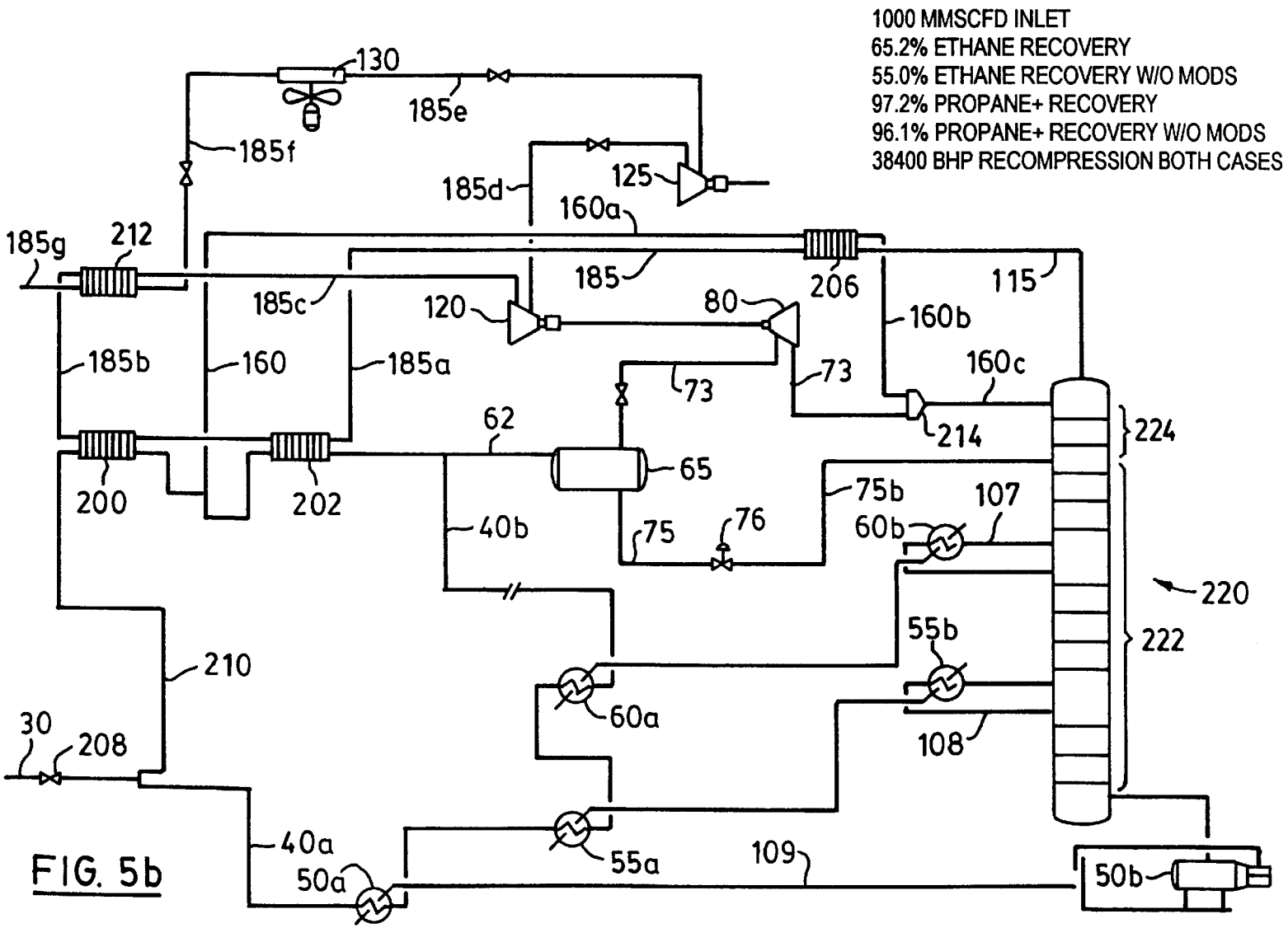
FIG. 5*b* is a drawing of a variant of the theoretical model of the apparatus shown in FIG. 5*a;*

Reference will now be made to FIG. 5*b,* which shows a further variant of the apparatus and method of the present invention. This again is for 1000 MMSCFD plant, and is similar in many respects to the configuration shown in FIG. 5*a.* For this reason, and again as before, description of common components is not repeated, and these common components are given the same reference numeral.

The difference in FIG. 5*b* is, in effect, that the two streams 73, 160*b* of FIG. 5*a* are now combined into a single stream (160*c*), before entering the top of the fractionation column 220. Thus, in FIG. 5*b,* the stream 160*b* joins with stream 73 in a static mixer 214. The combined stream downstream from the static mixer 214 is indicated at 160*c*. The static mixer 214 is a motionless device, i.e. without any moving parts, and of known construction. It causes swirling in the fluid flowed downstream, which increases the turbulence in the piping and consequently increases the mass transfer rate. If the static mixer has a sufficient length, it is possible to approach one theoretical stage of contacting, equivalent to one theoretical stage in the column 220. It is expected that, for situations where it is not practical or possible to put trays in the top of the column 220 (e.g. in some retrofit applications where demethanizer columns are not belled or enlarged at the top at all) this configuration should provide a significant improvement at even less cost than retrofit with trays.

It can be noted that, as detailed above, the three tray modification gave an ethane recovery of 67.4%, whereas, as detailed in Table 4 below, static mixer 214 gives a recovery of 65.2%. Again, these are theoretical simulated results only and are predicated on the assumption that a full equilibrium stage can be achieved in the static mixer 214. It is expected that actual test results would be close, although likely not quite so good.

Figure 5C:
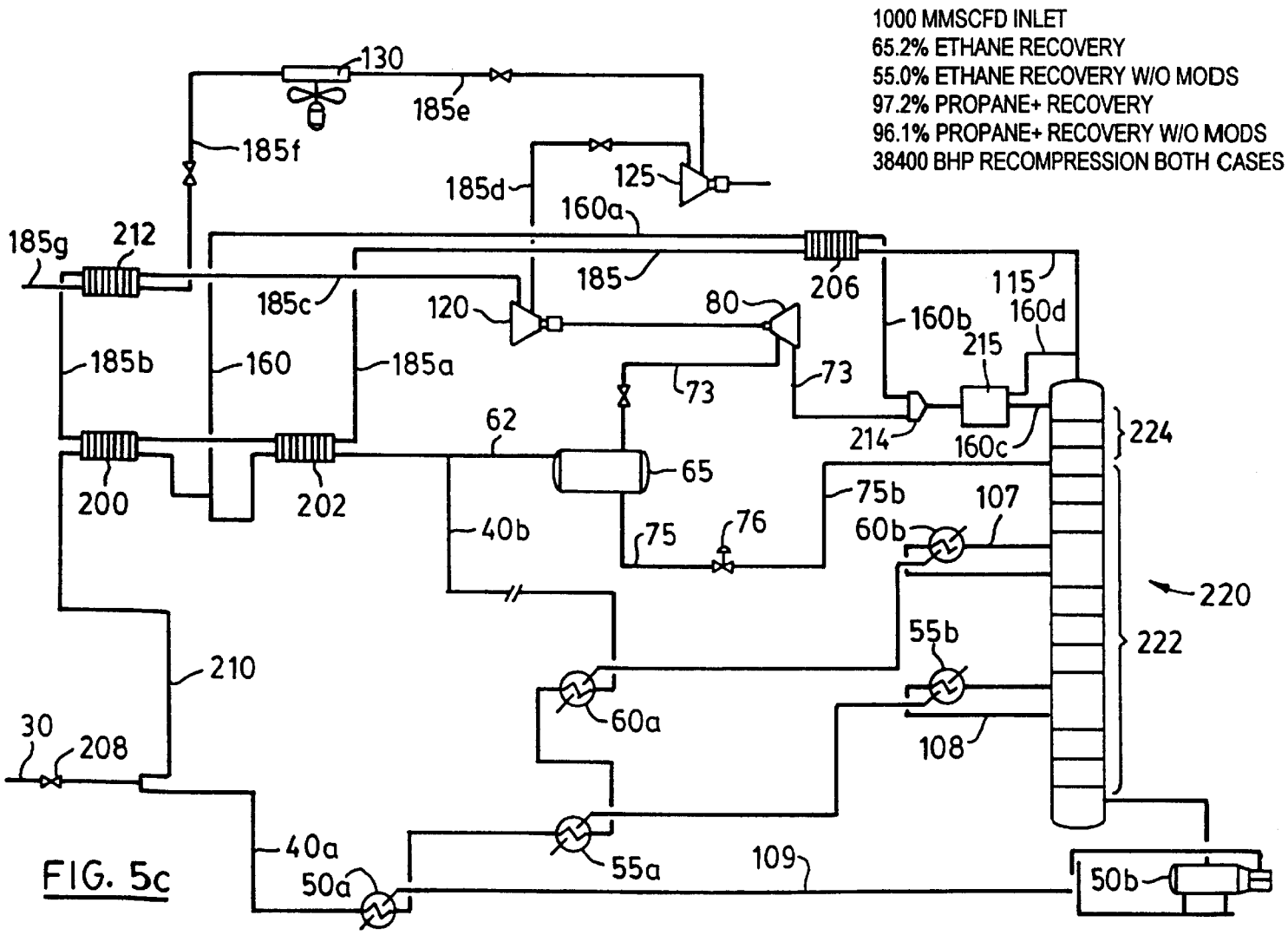
FIG. 5*c* is a drawing of a theoretical model which includes a static mixer for a plant with a second separator which separates expander vapours and bypasses them around the demethanizer column.

A variant of the proposal of FIG. 5*b* is shown in FIG. 5*c*. Here, there is provided a separator tank or vessel 215, similar to the separator 65, to separate the gas and liquids from the static mixer 214. Such a separator would have an outlet for liquid connected to the top of the column 220, as shown for stream 160*c*, and an outlet for vapour or gas connected to the stream 115, and indicated at 160*d*. Thus, FIG. 5*c* shows a typical application of a static mixer modification in which the lighter or vapour portion of the combined streams 73 and 160*b* is separated in the separator 215 and then flows around the demethanizer column 220 through the branch stream 160*d;* as this vapour flow can be a significnat part of the total flow, this can significantly reduce the flow rates at the top of the column 220. Theoretical simulations of the improvement offered by the static mixer 214 indicated that an 8% incremental ethane recovery could be achieved by implementing static mixing in the manner shown. Again, this is under the assumption that one theoretical stage of mixing could be achieved in the static mixer. With proper design and contact time in the mixer it should be possible to closely approach the predicted performance and effect of the static mixer 214.

TABLE 4

| Location | Temperature ° F. | Pressure p.s.i.a | Molar Flow lb moles/hr | Vapour Fraction |
|---|---|---|---|---|
| INLET STREAM 30 | 68 | 598.28 | 116546.84 | 1 |
| STREAM 40a | 67.87 | 596.25 | 24596.25 | 1 |
| stream 40b | −90.97 | 590.74 | 24596.25 | 0.94 |
| MAIN STREAM 210 | 67.87 | 596.25 | 91950.59 | 1 |
| stream 35 | −92.57 | 590.74 | 80970.13 | 0.93 |
| STREAM 160a | −36 | 593.49 | 10980.47 | 1 |
| stream 160b | −134.41 | 578.49 | 10980.47 | 0 |
| stream 160c | −138.59 | 330.06 | 109643.09 | 0.89 |
| stream 62 | −92.2 | 590.74 | 105566.38 | 0.93 |
| stream 75b | −122.56 | 332.06 | 6903.75 | 0.23 |
| stream 70 | −92.56 | 587.69 | 98662.63 | 1 |
| stream 73 | −132.93 | 330.06 | 98662.63 | 1 |
| STREAM 115 | −138.74 | 328.06 | 111205.24 | 1 |
| stream 185a | −111.5 | 322.86 | 111205.24 | 1 |
| stream 185b | 55.97 | 320.25 | 111205.24 | 1 |
| stream 185c | 99.82 | 313.72 | 111205.24 | 1 |
| stream 185d | 122.67 | 358.7 | 111205.24 | 1 |
| stream 185e | 223.53 | 626.71 | 111205.24 | 1 |
| stream 185f | 109.94 | 621.63 | 111205.24 | 1 |
| stream 185g | 67.98 | 613.51 | 111205.24 | 1 |

Figure 7:
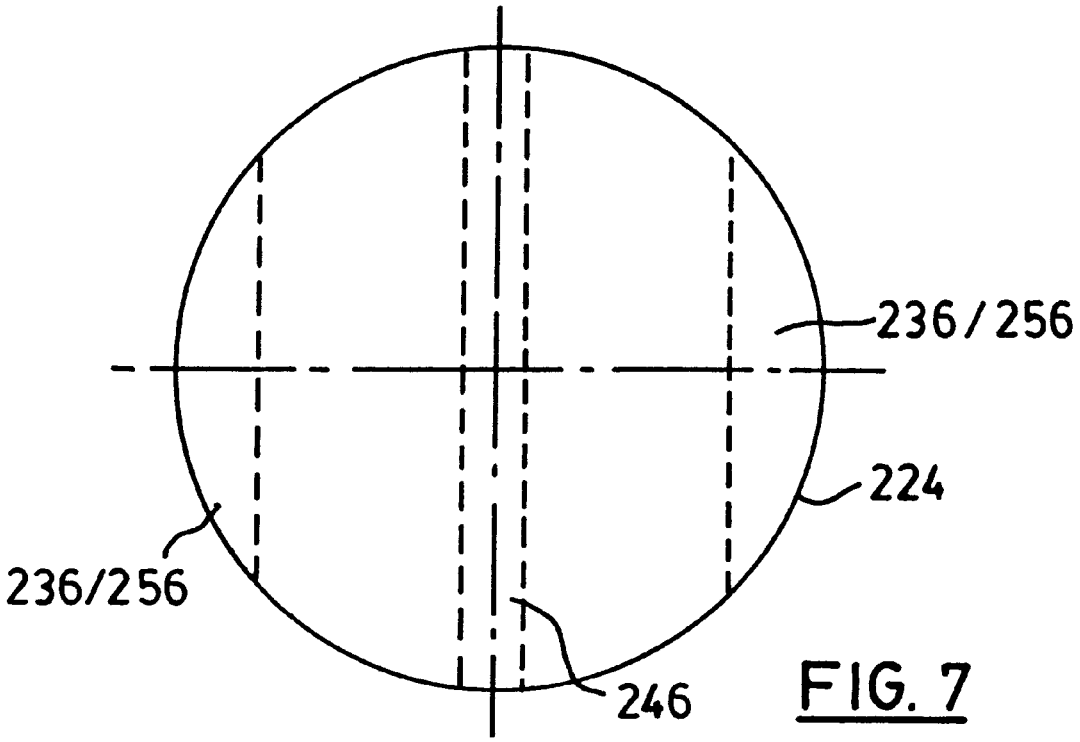
FIG. 7 is a schematic plan view showing the trays of FIG. 6.

Reference will now be made to FIGS. 6 and 7, which show details of the trays as shown in the top of the column 220. As shown, the column 220 has a relatively narrow bottom or body section 222 and a top or upper section 224 of much greater diameter. The bottom section 222, as indicated includes 10–15 theoretical trays, equivalent to 18–24 actual trays.

In the top section 224 of the column, there are three additional trays 13, 14 and 15, here identified as 226, 227 and 228.

The lowermost of the three trays, tray 226 has a central horizontal portion 230, with upwardly extending lips 232 along opposite sides, which lips 232 provide a weir to maintain a desired fluid level on top of the central portion 230. In known manner, the central portion would be provided with an array of bubble caps or valves. Side walls 234 include partially inclined sections 235, which are connected to a lower floor 236. Again, in known manner, the floor 236 can be provided with slots, permitting fluid to flow down through the slots to the tray below.

The tray 227 has a generally circular horizontal portion 240 and is provided with a slot 241 extending diametrically. Side walls 244 define the slot and include lips 242, again providing a weir function. The side walls 244 include lowermost inclined sections 245, to which a floor 246 is connected. Again, the floor 246 would be provided with slots for downflow of liquid, while the horizontal portion 240 would be provided with bubble caps or valves, to permit upward flow of vapour.

The uppermost tray 228 corresponds in many ways to the tray 226, and includes a central horizontal portion 250, lips 252 and side walls 254. The side walls 254 again include inclined sections 255, but here these incline outwardly and away from one another; for the tray 226, the inclined sections 235 incline inwardly, to follow a frusto-conical transition section 225 between the top and bottom sections 222, 224.

It will be appreciated that detailed design of the trays, bubble caps, louvres, mounting arrangements etc., can be largely conventional and follow known design practice. Such details do not form part of the present invention.

As noted above, conventional fractionation columns have a disengagement section, which typically may be 10 to 15 feet in height, with a diameter of 10 to 18 feet. Here, the top of the column has an upper cap 260. The distance between the lower edge of the upper cap 260 and the horizontal portion 250 of the tray 228 is only 2 foot 4 inches. It has surprisingly been found that this gives adequate disengagement or separation of the vapour and liquid phases.

There are also other benefits associated with the present invention. Significantly, the carbon dioxide content of the residue gas stream 115 is reduced, which aids in alleviating the $CO_2$ freezing problems commonly encountered at the upper sections of the column. Instead, a higher proportion of the carbon dioxide gas in the inlet gas is recovered in the ethane plus stream leaving the bottom of the column. The reason for the increased recovery of carbon dioxide is that it has a boiling point quite close to the boiling point of ethane. Therefore, as there is a higher recovery of ethane in the present invention, there is also a higher recovery of carbon dioxide. In trials, the carbon dioxide content of the residue gas leaving the upper portion of the column was reduced from 0.54 mole % to 0.52 mole %, at the same inlet gas composition.

Additionally, because the present invention requires the addition of the reflux section 150, there is an increased gas processing capability, since the inlet gas is initially further divided, and there is less gas flowing through the inlet heat exchangers.

It will be understood by persons skilled in the art that, although the present invention has been described in relation to a particular system, the invention may be implemented in any number of ways, particularly in the manner in which the various hydrocarbon streams are processed and delivered to the fractionation column. All such modifications are contemplated by the present invention.

Additionally, while the present invention has been described largely as a retrofit to existing facilities, it will be appreciated that the invention may be utilized in new facilities, and that advantages will be realized in such use. In particular, an increased recovery of ethane plus may be substantially achieved over conventional reflux designs, by the elimination of the high capital cost of a second separator which has conventionally been required.

It will be appreciated that various changes and modifications may be made within the spirit of the invention, and all such changes are included within the scope of the attached claims.

What is claimed is:

1. An apparatus for cryogenically separating an inlet hydrocarbon gas stream comprising at least methane and ethane into a residue gas stream comprising a major portion of the methane and a heavier hydrocarbon fraction comprising principally ethane and other heavier hydrocarbons, the apparatus comprising:

(1) a main inlet for the hydrocarbon mixture;

(2) a main stream connected to the main inlet and including a first separator for separating liquid and vapour phases, the first separator having a liquid phase outlet and a vapour phase outlet;

(3) a liquid phase stream connected to the liquid phase outlet and a vapour phase stream connected to the vapour phase outlet;

(4) a branch stream connected to the main inlet;

(5) a fractionation column including first, second and third inlets, the first inlet being connected to the liquid phase stream, the second inlet being connected to the vapour phase stream and the third inlet being connected to the branch stream, whereby the flow through the third inlet has substantially the same composition as the inlet gas, the second inlet being provided above the first inlet and the third inlet being provided above the second inlet;

(6) a first outlet means located at the bottom of the fractionation column for the heavier hydrocarbon fraction and a second outlet means at the top of the fractionation column for the residue stream;

(7) an outlet conduit connected to the second outlet means;

(8) first means for cooling the branch stream, including a first heat exchanger means provided between the outlet conduit and the branch stream for heat exchange therebetween, for cooling the incoming hydrocarbon gas branch stream and heating the residue gas stream in the outlet conduit; and (9) second means for expanding and cooling the main stream.

2. An apparatus as claimed in claim 1, wherein the fractionation column includes a body portion of relatively small diameter and an upper portion of relatively large diameter, and a transition section between the body portion and the upper portion wherein the first inlet is provided towards the upper end of the body portion, the third inlet is provided in the upper portion of relatively large diameter, and the second inlet is provided in one of the transition section and an end of one of the body portion and the upper portion adjacent the transition section.

3. An apparatus as claimed in claim 2, wherein the fractionation column includes packing comprising a plurality of trays.

4. An apparatus as claimed in claim 3, wherein the upper portion includes one to six trays and a relatively small disengagement zone above the trays for liquid and vapour separation.

5. An apparatus as claimed in claim 4, wherein the diameter of the upper zone is in the range of ten to seventeen feet.

6. An apparatus as claimed in claim 5, wherein the upper section includes a disengagement zone having a height in the range of three feet or less.

7. An apparatus as claimed in claim 4, which includes reboiler means connected to the fractionation column, for reboiling lighter hydrocarbon fractions from the column, and a further branch stream in which the reboiler means is located and which is connected between the main inlet and the inlet of the first separator, for providing heat for the reboiler means from the inlet hydrocarbon gas stream.

8. An apparatus as claimed in claim 7, wherein the second means for expanding and cooling includes a second heat exchanger means provided in the outlet conduit and in the main stream, upstream of the first separator, for heat exchange between flows in the outlet conduit and the main stream.

9. An apparatus as claimed in claim 8, wherein the first means for cooling includes a throttle valve in the branch stream and the second means for expanding and cooling includes a throttle valve in the liquid phase stream and an expander in the vapour stream and wherein the outlet conduit includes a compressor driven by the expander.

10. An apparatus as claimed in claim 9, wherein the first and second heat exchange means are connected so that the residue gas passes through the first heat exchange means and at least a portion of the residue gas then passes through the second heat exchange means.

11. An apparatus as claimed in claim 10, wherein the first heat exchange means comprises two separate heat exchange elements, and wherein one portion of the residue gas passes through both heat exchange elements, and another portion of the residue gas passes through just one heat exchange element before passing to the second heat exchange means.

12. An apparatus as claimed in claim 9, which includes a third heat exchange means connected between the main inlet and both of the main stream and the branch stream, whereby both of the main and branch streams flow through the third heat exchange means, wherein the third heat exchange means is located in the outlet conduit for heat exchange between the residue gas stream and the combined flows of the main stream and the branch stream.

13. An apparatus as claimed in claim 12, wherein, in the outlet conduit, the second heat exchange means is downstream from the first heat exchange means and the third heat exchange means is downstream from the second heat exchange means.

14. An apparatus as claimed in claim 13, wherein the outlet conduit, downstream from the first heat exchange means, includes, in the following order, a fourth heat exchange means, the compressor, an additional compressor, a third heat exchange means for cooling the compressed residue gas, and a further connection through the fourth heat exchange means whereby the compressed gas is cooled and gas passing to the compressor is heated.

15. An apparatus as claimed in claim 1 or 8, which includes a static mixer, to which the vapour phase outlet of the first separator and the branch stream are connected, wherein the second and third inlets to the fractionation column are combined and are connected to the outlet of the static mixer, the combined second and third inlets being provided at the top of the fractionation column, whereby the static mixer causes contacting between the branch stream and the liquid phase stream prior to the fractionation column.

16. An apparatus as claimed in claim 15, wherein the static mixer is sized to provide mass transfer substantially equivalent to one theoretical stage of contacting in a fractionation column.

17. An apparatus as claimed in claim 15, which includes a second separator connected to the outlet of the static mixer, which second separator includes a second liquid phase outlet and a second vapour phase outlet, wherein the second liquid phase outlet is connected to the combined second and third inlets and the second vapour phase outlet is connected to the outlet conduit, whereby a portion of the residue gas stream does not pass through the fractionation thereby to reduce the flow of residue gas in the fractionation column.

18. An apparatus as claimed in claim 1, wherein the second means for expanding and cooling the main stream includes an expander connected to the vapour phase outlet of the first separator and having an expander outlet for cooled and expanded gas, and wherein a second separator is connected to the expander outlet, the second separator including a second liquid phase outlet and a second vapour phase outlet, with the second liquid phase outlet being connected to the second inlet of the fractionation column and the second vapour phase outlet being connected to the outlet conduit, whereby a portion of the residue gas stream does not pass through the fractionation column thereby to reduce the flow of residue gas in the fractionation column.

19. An apparatus as claimed in claim 1, wherein the branch stream comprises largely a liquid phase.

20. A method of retrofitting an existing cryogenic apparatus for separating a compressed inlet hydrocarbon gas stream comprising at least methane and ethane into a residue fraction comprising a major portion of the methane and a heavier hydrocarbon fraction comprising principally ethane and other heavier hydrocarbons, said existing apparatus comprising:

(a) a main inlet for the hydrocarbon gas;

(b) means for expanding and cooling the inlet gas into a mixture of liquid and vapour phases connected to the main inlet;

(c) means for separating said liquid and vapour phases comprising:

(i) a fractionation column having a body portion and an upper portion above the body portion and generally enlarged with respect to the body portion, said upper portion being substantially empty and being originally intended to provide a disengagement zone;

(ii) at least one inlet means for supplying the vapour and liquid phases to the column provided on at least the body portion and connected to the means for expanding and cooling the inlet gas;

(iii) a first outlet means located at the bottom of the bottom portion for withdrawing the heavier hydrocarbon fraction from the column;

(iv) a second outlet means located at the top of the upper portion for withdrawing the residue stream from the column; and (v) packing means in said body portion for increasing the amount of contact between the liquid and vapour phases; the method comprising:

(1) providing additional packing in the disengagement zone in the upper enlarged portion of the column to provide additional contact between the liquid and vapour phases;

(2) providing a branch stream between the main inlet and the upper portion; and (3) providing a first heat exchange means in the branch stream, for cooling the branch stream so that at least a portion of the branch stream is in the liquid phase, whereby hydrocarbons discharging into the upper portion from the branch stream are at least partially liquid.

21. A method as claimed in claim 20, wherein the additional packing in the upper portion of the column comprises a plurality of trays spaced vertically in said upper portion of the column.

22. A method as claimed in claim 21, which comprises providing one to six trays.

23. A method as claimed in claim 22, which comprises providing three trays into an upper portion which is approximately 12½ feet in diameter and approximately 10 feet high, and wherein the trays are positioned in the upper portions so as to leave a disengagement zone of less than three feet.

24. A method as claimed in claim 23, wherein the upper portion includes a frustro-conical portion, wherein one of the trays is provided extending into the frustro-conical portion.

25. A method as claimed in claim 24, wherein the method is carried out in an apparatus including a main heat exchange means in the means for expanding and cooling the inlet gas, which main heat exchange means is connected to the second outlet means, whereby the residue stream absorbs heat from the incoming hydrocarbon gas, the method comprising providing the first heat exchange means in the branch stream as first and second separate heat exchange elements and connecting the heat exchange elements such that the residue stream passes through the first heat exchange element, and only a portion of the residue stream passes through the second heat exchange element, with the remainder of the residue stream passing through the main heat exchange means, the portions of the residue stream subsequently being combined for discharge from the apparatus.

26. A method as claimed in claim 20, the method additionally comprising:

(1) providing means for expanding and cooling said vapour phase of the inlet gas;

(2) providing a static mixer, to which the branch stream, downstream from the first heat exchange means and the vapour phase, downstream from the means for expanding and cooling, are connected, and providing a connection between an outlet of the static mixer and the upper portion of the fractionation column.

27. A method as claimed in claim 26, which additionally includes:

(1) providing second separation means, connected to the outlet of the static mixer and including a second vapour phase outlet and a second vapour phase inlet;

(2) providing a connection between the second liquid phase outlet and the upper portion of the fractionation column; and (3) providing an outlet conduit for residue gas, and connecting the outlet conduit to both the second outlet means and the second vapour phase outlet.

28. A method of separating a hydrocarbon feed gas stream comprising at least methane and ethane into a residue gas fraction comprising a major portion of the methane and a heavier hydrocarbon fraction comprising principally ethane and other heavier hydrocarbons, the method comprising:

(1) passing the hydrocarbon gas stream through a first heat exchange means to cool the gas stream;

(2) separating the gas stream into first, second and third streams, with the second stream comprising a major portion of the gas flow;

(3) expanding the gas, after it has been cooled, to lower the temperature of the first, second and third streams, wherein the third stream, after cooling and expansion, is substantially in the liquid phase;

(4) providing a fractionation column including packing;

(5) supplying the third stream to the top of the fractionation column, the second stream to the fractionation column below the third stream and the first stream to the fractionation column below the second stream;

(6) collecting the residue gas fraction from the top of the fractionation column and the heavier hydrocarbon fraction from the bottom of the fractionation column, and passing the residue gas fraction through the first heat exchange means to transfer heat to the residue gas.

29. A method as claimed in claim 28, which includes providing a fractionation column comprising a lower portion having a relatively small diameter, an upper portion having a relatively large diameter, and a transition section therebetween and a packing within the lower and upper portions, wherein the packing comprises, for the upper portion, six or less trays; wherein step (5) comprises supplying the third stream to the top of the upper portion, the second stream to the top of one of the transition section and one of the upper and lower portions adjacent the transition section and the first stream to the lower portion below the second stream; and wherein step (6) comprises collecting the residue gas fraction from the top of the upper portion and the heavier hydrocarbon fraction from the bottom of the lower portion, wherein the residue gas fraction passes through the first heat exchange means to reheat the residue gas fraction and cool the incoming gas.

30. A method as claimed in claim 29, which comprises:

splitting the inlet hydrocarbon gas stream into a main stream and a branch stream, the branch stream comprising the third stream and the main stream being subsequently split into the first and second streams.

31. A method as claimed in claim 30, which includes splitting a portion of the hydrocarbon feed gas stream off into a further branch stream, and passing the further branch stream through reboiling means and then recombining the further branch stream with the main stream, the reboiler means, reboiling lighter hydrocarbon fractions from the fractionation column.

32. A method as claimed in claim 31, which includes passing the main gas stream through a second heat exchange means and the main and branch streams together through a third heat exchange means, to cool the main and branch streams, and passing the residue gas stream through the second and third heat exchangers to extract heat from the main and branch streams.

33. A method as claimed in claim 32, which further comprises:

passing the main gas stream, after cooling, to a first separator and separating the main gas stream into liquid and vapour phases, with the liquid phase forming the first stream and the vapour phase forming the second stream.

34. A method as claimed in claim 33, which includes passing the first stream through a throttle valve to expand the first stream and passing the second stream through an expander, to expand the second stream.

35. A method as claimed in claim 34, which includes passing the residue stream, after leaving the third heat exchange means, through compressor and driving the compressor by the expander.

36. A method as claimed in claim 34, which includes combining the vapour stream and the branch stream in a static mixer, and then supplying the combined branch and vapour stream as a single stream to the top of the upper portion of the fractionation column.

37. A method as claimed in claim 36, which comprises mixing together the branch stream and the vapour stream sufficiently to effect contacting approximately equivalent to one theoretical stage of contacting.

38. A method as claimed in claim 36, which includes:

(1) separating the combined vapour stream and branch stream in a separator into a second vapour phase and a second liquid phase;

(2) supplying the second liquid phase to the upper portion of the fractionation column, and combining the second vapour stream with gas flow from the top of the upper portion of the fractionation column, to form the residue gas fraction.

39. A method as claimed in claim 28, which includes:

(1) splitting the inlet hydrocarbon gas stream into a main stream and a branch stream, the branch stream comprising the third stream;

(2) passing the main gas stream, after cooling, to a first separator and separating the main gas stream into a first liquid phase and a first vapour phase, with the first liquid phase forming the first stream and the first vapour phase forming the second stream;

(3) passing the second stream through an expander to expand the second stream;

(4) combining the second stream and the branch stream together in a static mixer, to form a combined stream;

(5) separating the combined stream in a separator into a second vapour phase and a second liquid phase;

(6) supplying the second liquid phase to the top of the fractionation column and combining the second vapour phase with gas from the top of the fractionation column, to form the residue gas fraction.

40. A method as claimed in claim 28, wherein the inlet gas is supplied at a rate up to 600–1000 MMSCFD.

* * * * *